US009781808B2

(12) United States Patent
Jørgensen et al.

(10) Patent No.: US 9,781,808 B2
(45) Date of Patent: Oct. 3, 2017

(54) METHOD OF CONTROLLING AN ILLUMINATION DEVICE HAVING A NUMBER OF LIGHT SOURCE ARRAYS

(75) Inventors: Dennis Thykjær Jørgensen, Rønde (DK); Flemming Freese Bjerre, Aarhus C (DK); Mikkel Holch, Højbjerg (DK)

(73) Assignee: Martin Professional ApS, Aarhus N. (DK)

( * ) Notice: Subject to any disclaimer, the term of this patent is extended or adjusted under 35 U.S.C. 154(b) by 328 days.

(21) Appl. No.: 13/990,574

(22) PCT Filed: Nov. 21, 2011

(86) PCT No.: PCT/DK2011/050440

§ 371 (c)(1),
(2), (4) Date: Sep. 12, 2013

(87) PCT Pub. No.: WO2012/072081

PCT Pub. Date: Jun. 7, 2012

(65) Prior Publication Data

US 2013/0342132 A1 Dec. 26, 2013

(30) Foreign Application Priority Data

Dec. 2, 2010 (DK) ..... 2010 01094

(51) Int. Cl.
*H05B 37/02* (2006.01)
*H05B 39/04* (2006.01)
(Continued)

(52) U.S. Cl.
CPC ..... *H05B 37/02* (2013.01); *H05B 33/0869* (2013.01)

(58) Field of Classification Search
CPC ..... H05B 37/02; H05B 33/0869
(Continued)

(56) References Cited

U.S. PATENT DOCUMENTS 7,012,382 B2 * 3/2006 Cheang et al. ..... 315/291
7,626,345 B2 * 12/2009 Young ..... 315/307
(Continued)

FOREIGN PATENT DOCUMENTS

WO WO2007/019663 2/2007

OTHER PUBLICATIONS

International Search Report; International Application No. PCT/DK2011/050440; International Filing Date: Nov. 21, 2011; 3 pages.

*Primary Examiner* — Brandon S Cole
(74) *Attorney, Agent, or Firm* — Blank Rome LLP

(57) ABSTRACT

The present invention discloses an illumination device comprising:

a first array of light sources comprising a number of a first type light sources and a number of a second type light sources;

a second array of light sources comprising a number of said first type light sources;

processing means adapted to controlling the first array by simultaneously controlling the intensity of all of said light sources light sources of the first array;

controlling the second array by simultaneously controlling the intensity of all of the light sources light sources of the second array.

The present invention discloses further a method for controlling such illumination device.

17 Claims, 6 Drawing Sheets

(51) Int. Cl.
*H05B 37/00* (2006.01)
*H05B 33/08* (2006.01)

(58) Field of Classification Search
USPC ..... 315/291–311
See application file for complete search history.

(56) References Cited

U.S. PATENT DOCUMENTS

| | | | | |
|---|---|---|---|---|
| 7,764,026 | B2 * | 7/2010 | Dowling et al. | 315/307 |
| 7,830,356 | B2 * | 11/2010 | Lee et al. | 345/102 |
| 7,884,553 | B2 * | 2/2011 | Wada et al. | 315/185 R |
| 8,207,914 | B2 * | 6/2012 | Cok et al. | 345/76 |
| 2005/0242742 | A1 * | 11/2005 | Cheang | H05B 33/086 315/149 |
| 2006/0186819 | A1 * | 8/2006 | Young | H05B 33/0866 315/158 |
| 2007/0236447 | A1 | 10/2007 | Lee et al. | |
| 2008/0002103 | A1 * | 1/2008 | Lee | G02F 1/133603 349/68 |
| 2010/0207546 | A1 * | 8/2010 | Jung | H05B 33/0818 315/297 |

* cited by examiner

METHOD OF CONTROLLING AN ILLUMINATION DEVICE HAVING A NUMBER OF LIGHT SOURCE ARRAYS

FIELD OF THE INVENTION

The present invention relates to an illumination device capable of performing additive color mixing by regulating the intensity of at least a first array of light sources and a second array of light sources in relation to each other in order to achieve a desired color or a desired color temperature.

BACKGROUND OF THE INVENTION

Light fixtures creating various effects are getting more and more used in the entertainment industry in order to create various light effects and mood lighting in connection with live shows, TV shows or as a part of an architectural installation.

Typically, such variable color light sources comprise a plurality of individually controllable light sources such that each individually controllable light source emits light of a predetermined color. For example, in an RGB system, the variable-color light source may comprise individually controllable light sources of the most common primary colors red, blue, and green. By controlling the relative brightness of the respective individually controllable light sources of the different primary colors almost any color in the visible spectrum may be generated by means of an additive mixing of the respective primary colors, resulting in output light of the desired color and intensity.

U.S. Pat. No. 6,016,038 and U.S. Pat. No. 6,806,659 disclose systems and methods relate to LED systems capable of generating light, such as for illumination or display purposes. The light-emitting LEDs may be controlled by a processor to alter the brightness and/or color of the generated light, e.g., by using pulse-width modulated signals. The disclosed illumination device comprises LEDs including at least two different colors; a switching device, interposed between the LEDs and a common potential reference, including at least two switches corresponding to current paths of the two different color LEDs; a controller that opens and closes the switches according to a predetermined duty cycle; and a hand-held housing with a compartment for containing a power source and the common reference potential, as well as a lens assembly for reflecting light from the LEDs. The LEDs of different colors are provided in LED sets each preferably containing serial/parallel array of LEDs of the same color and these LEDs are individual controllable by the controller.

The illumination devices as disclosed by U.S. Pat. No. 6,016,038 and U.S. Pat. No. 6,806,659 can also be used to provide a white illumination device where the color temperature can be varied for instance as described in U.S. Pat. No. 6,636,003. U.S. Pat. No. 6,636,003 discloses a LED arrangement which produces a color temperature adjustable white light. The LED arrangement includes one or more white LEDs and a first drive circuit operable to supply a first drive current to the one or more white LEDs such that a white light is output at a desired intensity. The LED arrangement further includes one or more colored LEDs arranged such that a light output from the one or more colored LEDs combines with the white light to produce a resultant light having a desired color temperature. The colored LEDs are driven by a second drive circuit which supplies a second drive current to the one or more colored LEDs such that a colored light is output at a desired intensity, the intensity of the colored light output from the one or more colored LEDs being adjustable so as to adjust the color temperature of the resultant light.

Multi-colored illumination devices as disclosed by U.S. Pat. No. 6,016,038 and U.S. Pat. No. 6,806,659 can generate many different colors, however the overall brightness of the satiated colors (like red, green or blue) are reduced as a smaller number of light sources are activated when such device provides a satiated color. In some situations the illumination device is intended to provide only one single color and in order to enhance the overall brightness of the satiated color the illumination device is then alternatively provided with a single array of light sources emitting the same color instead of three arrays of light sources having different color.

However when light from several of such illumination devices are combined into one illumination (e.g. in order to illuminate architectural structure or a large stage area with the same color) color differences might occur, as the light sources used in two different illumination devices might differ. The reason for this is fact that it is difficult to manufacture light sources emitting the exact same color and brightness. This problem is a widely known issue in connection with LEDs and the LED manufacturers have assisted the illumination device providers by pre-sorting or binning the LEDs into smaller ranges of variability prior to shipment. The smaller range of LED input stimuli has assisted the assembler in producing a target output color. Acceptable color rendering is still a demanding task because even the bins have a sizeable range of the performance variations and the cost of pre-sorted binnings are much higher than regular binnings.

It is known that it is possible to compensate for the differences in color and brightness of the same type/color of light sources in two different multi-color illumination device by using the two other types/colors light sources colors to align the overall color and/or brightness of the two illumination devices. The known multi-color illumination device can be adapted to a bright single color illumination device which can compensate for the color/brightness differences by increasing the number of light sources emitting the single color and reducing the number of the other light sources. However this requires redesign of both software and hardware as at least printed circuited boards, drivers circuit, power supplies need to be dramatically redesigned which will increase manufacturing costs.

Further, due to the varying characteristics and potential non-linearity of the individual light sources, it is difficult to obtain a precise color control at different brightness values. This typically requires a cumbersome manual adjustment of the individual sources or a complicated and costly feed-back control of the light sources. For example, it is cumbersome to control the individual potentiometers such that the overall brightness of a variable-color light source assembly is varied while keeping the color (e.g. the hue and saturation) constant. In a multicolored illumination device these effects can be reduced by calibrating the illumination device for instance as described in WO2007/062662, U.S. Pat. No. 7,626,345, WO2001/052901, US 2004/135524 or WO 2009/034060.

WO 2007/062662 discloses a control device for controlling a variable-color light source, the variable-color light source comprising a plurality of individually controllable color light sources. The control device comprises a control unit for generating, responsive to an input signal indicative of a color and a brightness, respective activation signals for each of the individually controllable color light sources. The control unit is configured to generate the activation signals from the input signal and from predetermined calibration data indicative of at least one set of color values for each of the individually controllable light sources.

U.S. Pat. No. 7,626,345 discloses a manufacturing process for storing measured light output internal to an individual LED assembly, and an LED assembly realized by the process. The process utilizes a manufacturing test system to hold an LED light assembly a controlled distance and angle from the spectral output measurement tool. Spectral coordinates, forward voltage, and environmental measurements for the as manufactured assembly are measured for each base color LED. The measurements are recorded to a storage device internal to the LED assembly. Those stored measurements can then be utilized in usage of the LED assembly to provide accurate and precise control of the light output by the LED assembly.

WO2002/052901 discloses a method and luminaire for driving an array of LEDs with at least one LED in each of a plurality of colors in a luminaire. This method controls the light output and color of the LEDs by measuring color coordinates for each LED light source for different temperatures, storing the expressions of the color coordinates as a function of the temperatures, deriving equations for the color coordinates as a function of temperature, calculating the color coordinates and lumen output fractions on-line, and controlling the light output and color of said LEDs based upon the calculated color coordinates and lumen output fractions.

US 2004/135524 relates to a method and system for compensating for color variations due to thermal differences in LED based lighting systems. The method and system involves characterizing the LEDs to determine what PWM (pulse-width modulation) is needed at various operating temperatures to achieve a desired resultant color. The characterization data is then stored in the microprocessor either in the form of a correction factor or as actual data. When an operating temperature that is different from a calibration temperature is detected, the characterization data is used to adjust the PWM of the LEDs to restores the LEDs to the desired resultant color.

WO 2009/034060 relates to a method for the temperature-dependent adjustment of the color or photometric properties of an LED illumination device having LEDs or LED color groups emitting light of different colors or wavelengths, emitting light of the same color or wavelength within a color group, the luminous flux portion thereof determining the light color, color temperature, and/or the color location of the light mixture emitted by the LED illumination device, characterized by measurement of the board temperature and/or junction temperature of at least one LED, determination of at least one temperature-dependent value determining the emission spectra E(?) of the variously colored LEDs as a function of the wavelength of the variously colored LEDs from calibration data stored for each of the variously colored LEDs, determination of the luminous flux portions of the variously colored LEDs for a light mixture comprising a prescribed light color, color temperature, and/or color location at the measured temperature as a function of the at least one temperature-dependent value determined, and adjustment of the determined luminous flux portions at the variously colored LEDs.

DESCRIPTION OF THE INVENTION

The object of the present invention is to solve the above described limitations related to prior art. This is achieved by a illumination device and a method of controlling a illumination device as defined in the independent claims. The dependent claims describe possible embodiments of the present invention. The advantages and benefits of the present invention are described in the detailed description of the invention.

DETAILED DESCRIPTION OF THE INVENTION

Figure 1:
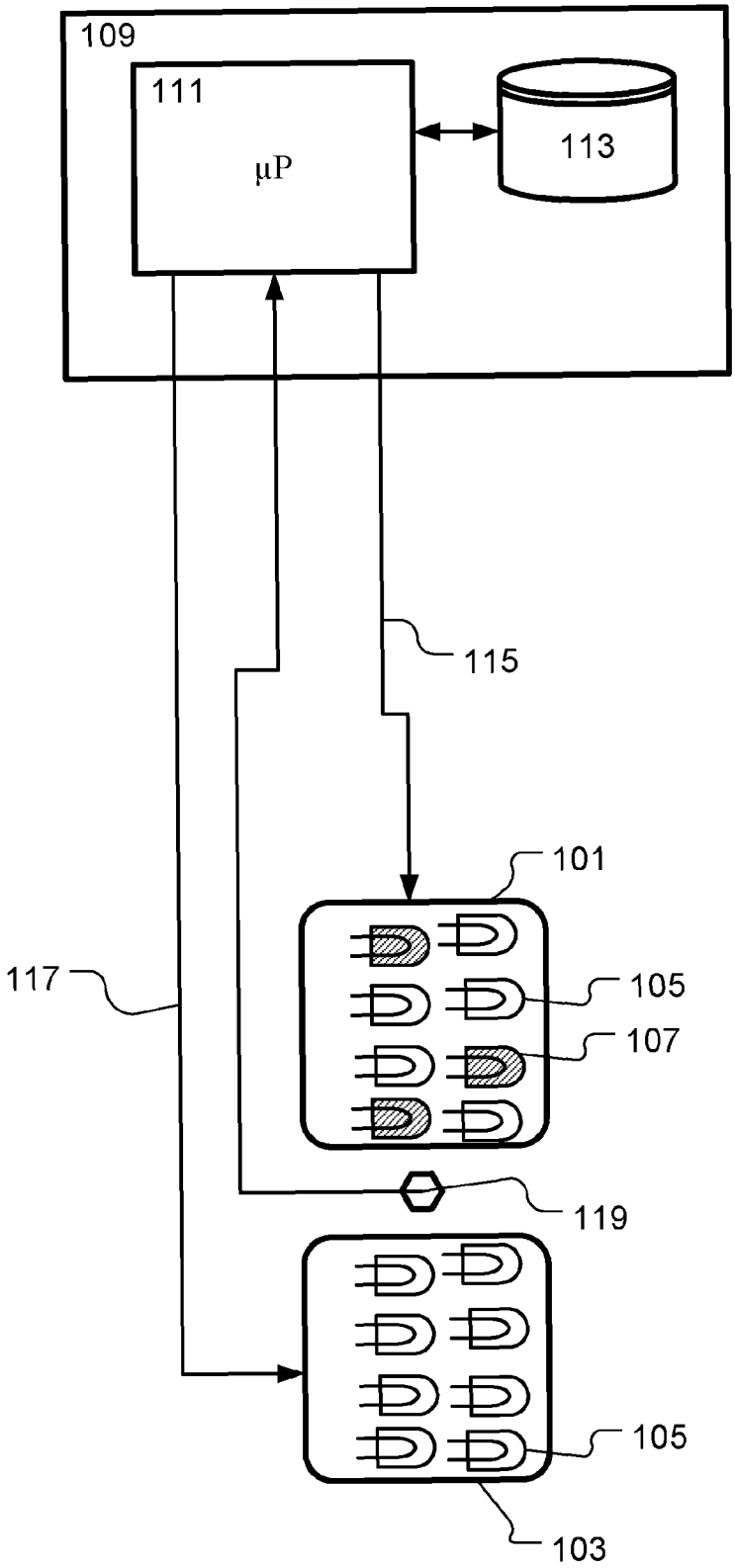
FIG. 1 illustrates an illumination device according to the present invention.

FIG. 1 illustrates an illumination device according the present invention. The illumination device comprises a first array 101 of light sources and a second 103 array of light sources. The first array 101 comprises a number of a first type light sources 105 and a number of a second type light sources 107 (shaded) whereas the second array 103 only comprises a number the first type light sources 105. The illumination device comprises a control unit 109 comprising a processor 111 and a memory 103.

The processing means 109 is adapted to control the first array 101 by simultaneously controlling the intensity of all of the light sources 105 and 107 light sources of the first array 101. Meaning the intensity of the light sources of the first array are controlled based on the same control signal 115 or by identical control signals for instance a pulse width modulation signal having the same duty cycle, a voltage regulated or current regulated DC signal etc.

The processing means 109 is also adapted to control the second array 103 by simultaneously controlling the intensity of all of the light sources 105 light sources of the second array 103. Meaning the intensity of the light sources of the second array 103 are controlled based on the same control signal 117 or by identical control signals for instance a pulse width modulation signal having the same duty cycle, a voltage regulated or current regulated DC signal etc.

The processing means 109 are further adapted to perform the controlling of the first array 101 and said second array 103 individually. The first 101 and second 103 array can thus be controlled individually and independently of each other and each of the first 101 and second 103 array can thus be treated as two individually and independently light sources.

The illumination device according to the present invention makes it possible to provide a very bright single color illumination device where the above described problems related to the fact that it, due to the manufacturing, is difficult to provide light sources emitting exact the same color and brightness. This is achieved as a large number of a first type light sources emitting a first color is provided in both a first and second array of light sources which results the fact the first color is very bright. There are further provided a number of a second type light sources emitting a second color in the first array of light sources. The first type light source and the second type light sources of the first array are driven by the same control signal and the first array will thus acts as an individual light source where the second type light sources add a small amount of a second color to the output of the first array. The color of the first array will thus differ a little bit from the color of the second array and it is possible to compensate for an eventual mismatch in the colors of the first type light sources for instance in order to color align two illumination devices. The amount of second type light sources can be thus be chosen such that the possible color gamut provided by the first and second array of light sources makes it possible to compensate for an eventual color and brightness mismatch between the colors of the first type light sources. The brightness of the first type light sources is further very bright as a large number of first type light sources can be provided.

The skilled person realizes that the illumination device also can comprise a third array comprising a number of the first type light sources and a number of a third type light sources. The third array acts like the first array and the color of the third array will thus differ a little bit from the color of the first and second array and it possible to compensate for an eventual mismatch in the colors of the first type light sources for instance in order to color align two illumination devices.

The illumination device can for instance be adapted to provide very bright red light and the first type light sources can in such embodiment be red LEDs and the second and third type light source the then be respectively green and blue LED's. The skilled person realizes the first type light sources can be any kind color and that the second and third light sources can also be color different from the color of the first type light source.

The first type light source can in one embodiment be white light sources and the second and third type light sources can then be colored light sources which can be used to modify the color temperature of the white color. The skilled person realizes a fourth array comprising a number of the first type light sources and a number of a fourth type light sources, which makes it possible to make a very bright white light where it is possible to control the color temperature as small amounts of red, green and blue blight can be added to the total light output.

The illumination device according to the present invention makes it further possible to adjust a traditional multicolor illuminating device into a single color illumination device without the need for a major redesign of both software and hardware. The additional light sources of the first color can be provided by replacing a number of the other colors of the other light source arrays whereby the need for redesigning printed circuited boards, drivers circuit, power supplies are minimized. This reduces the manufacturing costs of such illumination devices as both multicolor, single color, white light illumination devices can be manufactures using the same hardware platform.

In one embodiment the processing means is adapted to control the first array of light sources based on a method as described below, where degrading data of the first array are determined based on obtained driving characteristics of both the first array and the second array and the degrading data of both the first type and second type light sources.

The processing means 111 is thus adapted to obtain first driving characteristics of the first array 101 and second driving characteristics of the said second array 103. These driving characteristics can for instance be obtained from the memory 113 where the driving characteristics can be stored or from additional detecting/measuring means cable of obtaining/detecting the driving characteristics. The first and second driving characteristics can be any kind of physical parameter related to respectively the first array and second array; where the physical parameter can be measured, detected or obtained when the first array are second array are activated.

For instance the first driving characteristics can be indicative of one or more of the following characteristics:

- first color characteristics of the first array describing the color and brightness of the light emitted by one or more of the light sources of the second array. The first color characteristic can for instance be expressed as color coordinates in a color map (e.g. a CIE diagram), a color vector defined by the tristimulus values of a human eye and/or a spectra of the light;
- first temperature of one or more of the light sources of the first array. The first temperature can for instance be a first calibration temperature obtained in connection with a calibration process or a first present temperature expressing the present temperature. The skilled person realize that the temperature can be measured directly at the light sources or obtained through other parameters indicative of the temperature of the light sources;
- a first voltages across one or more of the light sources of the first array;
- a first current through one or more of the light sources of the first array;
- first power consumption by of one or more of the light sources of the first array.

Similar, the second driving characteristics can be indicative of one or more of the following characteristics:

- second color characteristics of the second array describing the color and brightness of the light emitted by one or more of the light sources of the second light array. The second color characteristic can for instance be expressed as color coordinates in a color map (e.g. a CIE diagram), a color vector defined by the tristimulus values of a human eye and/or a spectra of the light;
- second temperature of one or more of the light sources of the second array. The second temperature can for instance be a second calibration temperature obtained in connection with a calibration process or a second present temperature expressing the present temperature. The skilled person realize that the temperature can be measured directly at the light sources or obtained through other parameters indicative of the temperature of the light sources;
- a second voltages across one or more of the light sources of the second array;
- a second current through one or more of the light sources of the second array;
- second power consumption by of one or more of the light sources of the second array.

The processing means is also adapted to obtain first degrading data and second degrading data of respectively the first type and second type of light sources, for instance by reading these data from the memory 113. The first degrading data and the second degrading data can respectively be indicative of the degrading of the first type and second type light sources as a function of temperature, time, power consumption or other physical parameters.

In this embodiment the illumination device comprises also means 119 for obtaining the temperature of at least one the first type 105 light source and at least one of the second type 107 light source. This can for instance be a temperature sensor adapted to measure the temperature of the PCB carrying the light sources, as this temperature can be use to determine the temperature of the light sources for instance based on a measurement of voltage and current through the light sources. However a temperature sensor measuring the temperature directly of the light sources can also are used.

Figure 2:
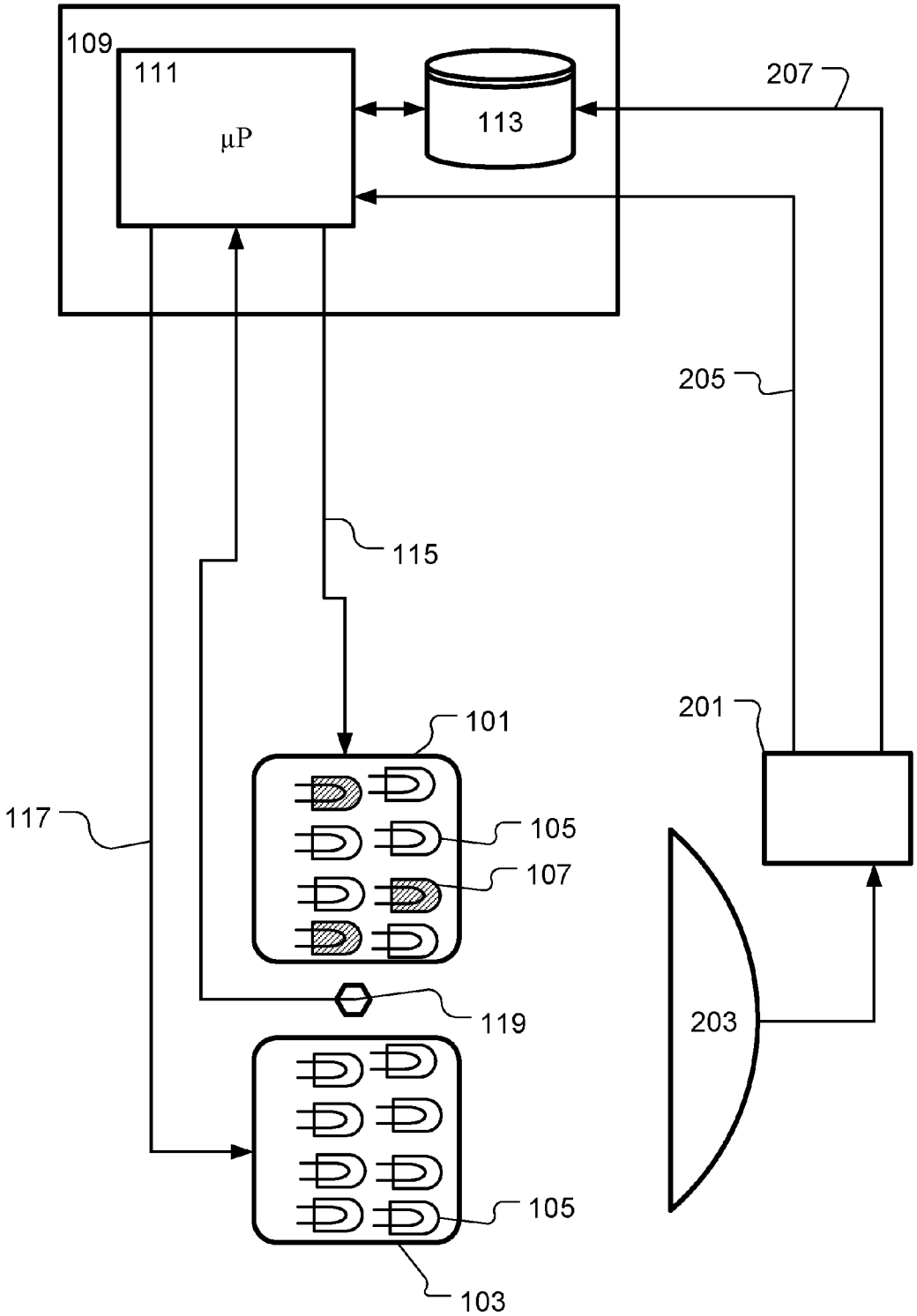
FIG. 2 illustrates calibration of the illumination device according to the present invention.

As described above the first and second driving characteristics can be first and second color characteristics of respectively the first array 101 and the second array 103. For instance, the first color characteristics of the first array 101 and the second color characteristics of the second array 103 can be measure and stored in the memory 113 by a calibration device 201 as illustrated in FIG. 2. The calibration device can comprise a detector 203 which can measure color characteristics the light emitted from the illumination device and for instance be a spectrometric device. The calibration device is connected 205 to the controller of the illumination device for sending instructions to the illumination device. The calibration device can for instance instruct the illumination device to activate the first array 101 of light sources while deactivate activating the second array 103. The detector 203 can the then measure the first color characteristics of the first array and the calibration device can thereafter store the first color characteristics into the memory 113. The first color characteristics can for instance be stored directly into the memory as illustrated by arrow 207, however the skilled person realizes the first color characteristics also can be communicated to the memory through the processing means 113 as illustrated by arrow 205. The calibration device can then instruct the illumination device to deactivate the first array 101 of light sources while activating the second array 103. The detector 203 can the then measure the second color characteristics of the second array and the calibration device can thereafter store 207 these second color characteristics into the memory 113. The calibrating device can also instruct the illumination device to obtain the temperature from the means for obtaining the temperature at some time during the calibration process and store this calibration temperature in the memory 113.

Figure 3:
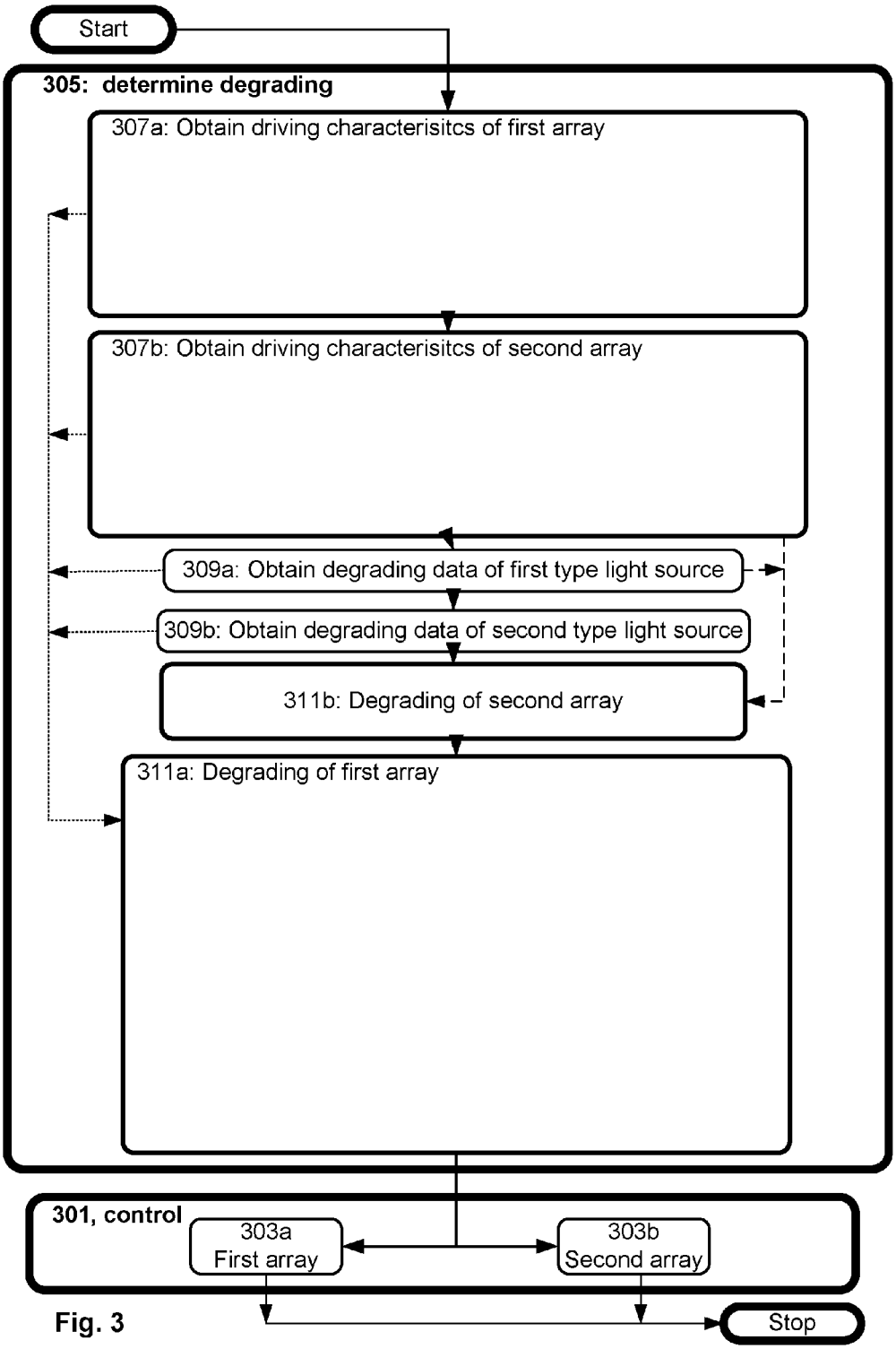
FIG. 3 illustrates a flow diagram of a method of controlling a illumination device according to the present invention.
Figure 4:
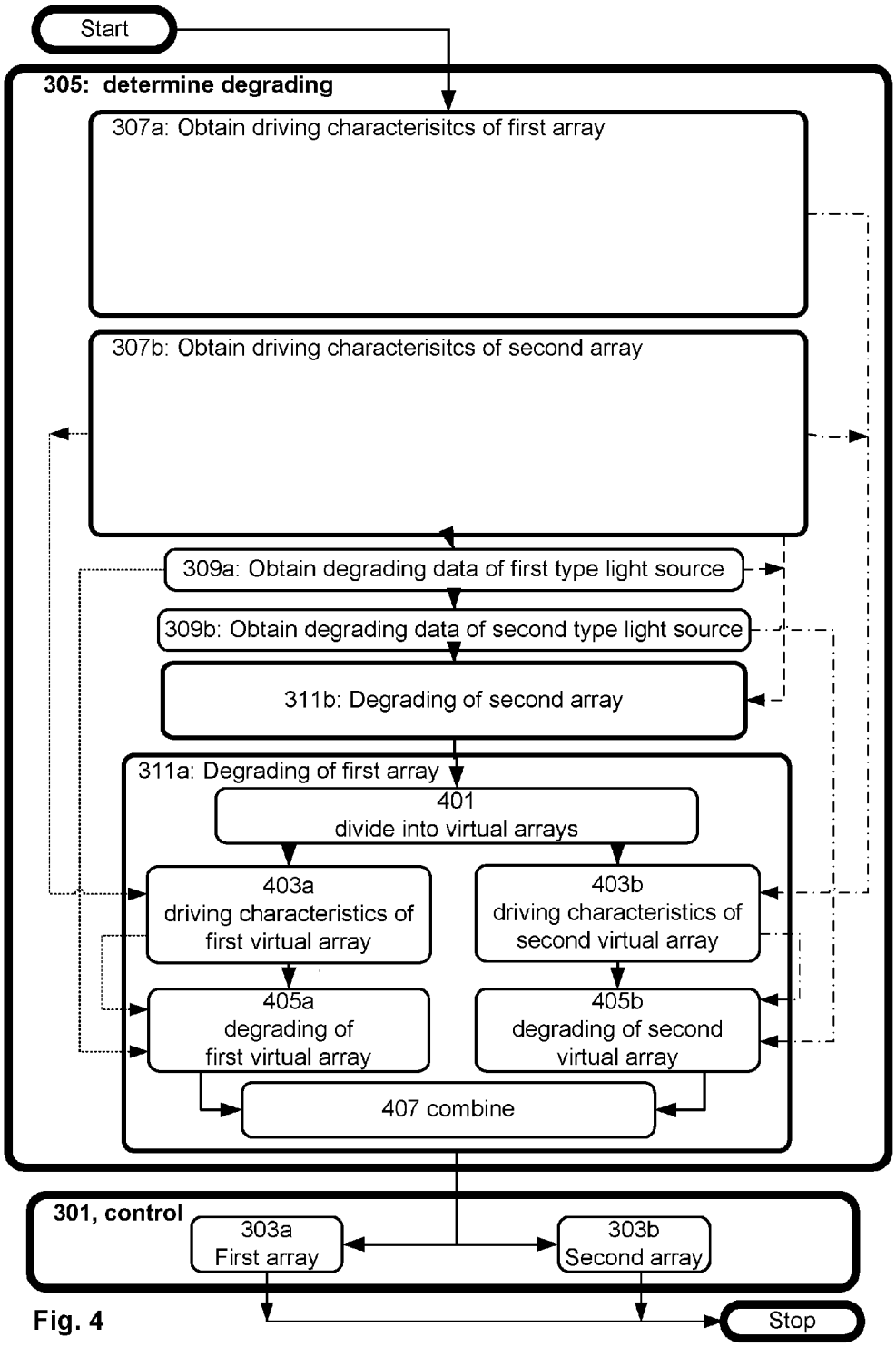
FIG. 4 illustrates further details of the method of FIG. 3.
Figure 5:
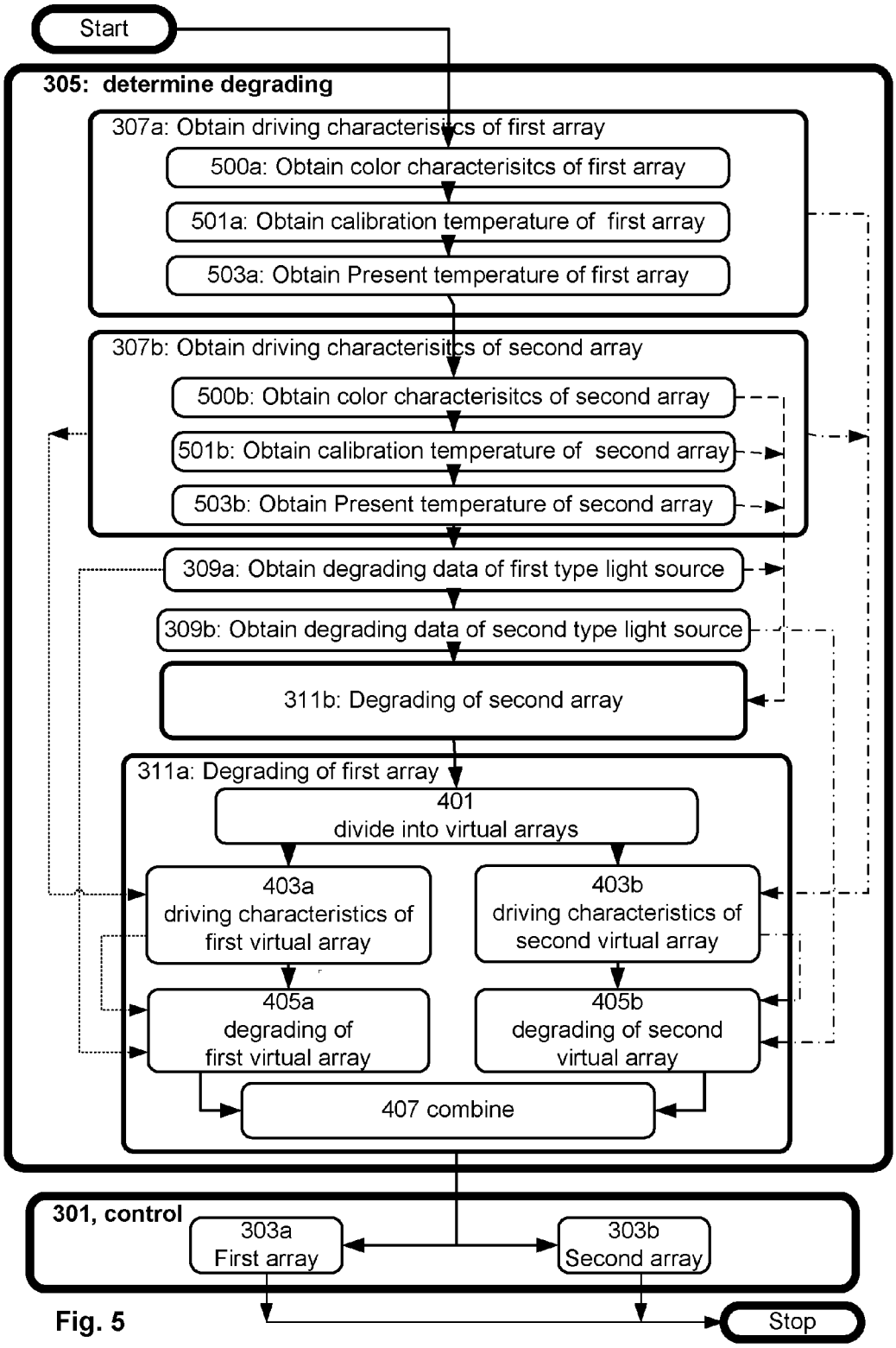
FIG. 5 illustrates further details of the method of FIG. 4.

FIGS. 3, 4 and 5 illustrate flow diagrams of a method of controlling an illumination device. The illumination device is like the one illustrated in FIG. 1 and comprises a first array 101 and second array 103 of light sources. The first array 103 comprises a number of a first type 105 light sources and a number of a second type 107 light sources, whereas the second array only comprises a number of said first type light sources 105. FIG. 3 illustrates the basic steps of the method while FIGS. 4 and 5 illustrate further details.

The method comprises the step 301 of controlling light output of the illumination device by controlling 303*a* the first array and controlling 303*b* the second array. In step 303*a* the intensity of all of the light sources of the first array 101 are controlled simultaneously and in step 303*b* the intensity of all of the light sources of the second array 101 are controlled simultaneously. Meaning that the intensity of the light sources of the same array are controlled in the same manner for instance by the same control signal or by identical control signals like a pulse width modulation signal having the same duty cycle, a voltage regulated or current regulated DC signal etc. The controlling of the first and second array are performed individually as indicated by two boxes and can for instance be performed at the same time, however the skilled person realizes the they also can be performed at different times. As described above, the first 101 and second 103 array can thus be controlled individually and/or independently of each other and the first 101 and second 103 array can thus be treated as two individually and independently light sources. Step 301 can for instance be performed based on an input signal (not shown) indicative of e.g. color, amount of dimming, strobing or other kind of parameters known in the art of intelligent lighting. The input signal can for instance be based on the DMX, ARTnet, Ethernet or any other communication protocol.

It is known that the output of light sources degrade as a function of temperature, lifetime and consumed power. The steps of controlling the first array and second array can both be based on a determination of the degrading of the lights sources in order to compensate/account for the degrading. The degrading of a light source can be determined based on the driving characteristics of the light source and predetermined degrading data related to the light sources.

The method comprises therefore the step of determining degrading 305 of the light sources of the illumination device in order to compensate/account for degrading of the first and second type light sources.

This step comprises the steps 307*a* and 307*b* of obtaining first and second driving characteristics of respectively the first array and the second array. The first and second driving characteristics can for instance be obtained from a memory where they have been pre-stored during a calibration process as described in FIG. 2. Alternatively the first and second driving characteristics of the first and second array can also be measured in real time if the illumination device comprises detection means for this or measured and stored in the memory at intervals. The driving characteristics can be any characteristics as described in connection with FIG. 1.

The first and second degrading data of the first type and second type light sources is obtained respectively in step 309*a* and 309*b* for instance from a memory where the degrading data have been stored. The degrading data can for instance be indicative of the amount of degrading of the light sources as a function of temperature, time, power consumption or any other parameter. The degrading data may be derived from a number of experiments performed by the light source manufacture or may be a theoretical expression related to the light source.

In step 311*b* the degrading of the second array is determined based on the obtained second driving characteristics of the second array and the degrading data the first type light sources (indicated by dashed lines) as known in the prior art. This is possible as the second array only comprises first type light sources and each of the light sources degenerates thus identically as they are driven substantially identical.

In step 311*a* the degrading of the first array is determined; however this degrading cannot be determined like the degrading of the second array, as the first array comprises both first type light sources and second type light sources and they do not necessary degrade in the same way even though they have been driven substantially identical. The degrading of the first array is therefore (indicated in dotted lines) besides the obtained first driving characteristics of the first array and the degrading data the first type light sources also determined based on the second driving characteristics of the second array and the degrading data of the second type light source. The second driving characteristic of the second array can be used to estimate driving characteristics of the first type lights sources of the first array which can be used to obtain driving characteristics of the second type light sources of the first array. The degrading of the first and second type light sources of the first array can then be obtained individually and used to determine the degrading of the first array. It is hereby possible to account for the fact that the first type light sources and the second type light sources of the first array not necessary degrade in the same way even though they are/have been driven under similar conditions.

For instance, the first and second driving characteristics can be indicative of respectively first and second color characteristics of the first and second array. The second color characteristics can then be used to determine the first type light sources' contribution to the first color characteristics and the second type light sources' contribution can then be obtained using the first color characteristics and the second color characteristics. The degrading of the first and second type light sources can then be determined individually and finally be combined into the total degrading of the first array.

Alternatively, the first and second driving characteristics can be indicative of consumed power of respectively the first and second array. The consumed power of second array can then be used to determine/estimate the consumed power of the first type light sources under given conditions. The consumed power of the first type light sources can then be used to determine/estimate consumed power of the second type light sources by using the power consumption of the first array. The temperature of the light sources depended on the consumed power and the degrading of the first type light sources and second type light sources and be determined individually based on their power consumption and finally be combined into the total degrading of the first array.

FIG. 4 illustrates a flow diagram of the method of FIG. 3 and illustrates further details of a possible embodiment. In this embodiment the step of determining degrading of the first array 311*a* comprises a number of sub steps.

Step 401 divides the first array into a first virtual array and a second virtual array. The first virtual array represents the first type light sources of the first array and the second virtual array represents the second type light sources of the first array.

The driving characteristic of the first virtual array is then determined 403*a* based (indicated in dotted lines) on the second driving characteristic of the second array. For instance, color characteristics of the first virtual array can be determined based on second color characteristics of the second array or power consumption of the first light sources of the first virtual array can be determined based on power consumption of the first light source of the second array. The degrading of the first virtual array is the determined 405*a* based (indicated by dotted lines) on the driving characteristics of the first virtual array and the degrading data of the first type light source.

The driving characteristic of the second virtual array is determined 403*b* based (indicated by dash-dotted lines) on the first driving characteristics of the first array and the second driving characteristic of the second array. Hereafter, the degrading 405*b* of the second virtual array is determined based (indicated by dash-dotted lines) on the second driving characteristic of the second virtual array and the degrading data of the first second light source.

Once the degrading of the first virtual array and the second virtual array are determined the degrading of the first array is determined by combining the degrading of the first virtual array and the degrading of the second virtual.

The sub steps 401-407 of step 311*a* makes it possible to determine the degrading of the first array based on a few calibration values and provides further a relatively simple method of obtaining the degrading of the first array.

FIG. 5 illustrates an embodiment of the method of FIG. 4 where the method the step 307*a* of obtaining the first driving characteristics comprises a step 500*a* of obtaining first color characteristics related to the first array, a step of obtaining a first calibration temperature parameter related to at least one of the light sources of the first array; and a step 503*a* of obtaining a first present temperature parameter related to the present temperature of at least one of the light sources of the first array.

The step 307*b* of obtaining the second driving characteristics comprises a step 500*b* of obtaining second color characteristics related to the second array, a step of obtaining a second calibration temperature parameter related to at least one of the light sources of the second array; and a step 503*b* of obtaining a second present temperature parameter related to the present temperature of at least one of the light sources of the second array.

The first color characteristic and the second color characteristics can be found by using a calibration device as described in FIG. 2 and the first and second calibration temperature can be obtained during the calibration process The first and second calibration temperature can for instance be measured directly at one of the light sources by a temperature measuring device, by measuring the temperature of the printed circuit board and then calculate the temperature from the power consumption of the light source. The power consumption of the light source can for instance be obtained by measuring the voltage across the light source and the current running through the light source.

The first and second present temperature of respectively the light sources of the first array and the present temperature of the light sources of the second array can be measured/obtained in similar ways as the calibration temperature.

In this embodiment the step 311*b* of determining degrading of the second array is based on the first degrading data, the second color characteristic, the second calibration temperature and the present temperature of the second array (indicated by the dotted lines). It is thus possible to determine how the color characteristics changes as a function of temperature and thus control the second array based on this degrading.

The new steps introduced in FIG. 5 make it possible to determine the degrading of the first and second array of light sources based in the present temperature of the light sources and there by compensate/account for temperature degrading of the light sources. This can for instance be carried out by controlling the first and second array accordingly to the determined degeneration.

The skilled person realizes that other degrading parameters can be used when determining the degrading of the light sources. For instance the degrading parameters can be a time parameter where the degrading is determined based how the light sources have been driven, e.g. by recording how the first and second light source array have been driven by recording the consumed power throughout the life time of the light fixture and in this way compensate/account for degrading due to time. The degrading parameter can also be a power parameter where the degrading of the light sources determined based on how much power is consumed by the light source.

Figure 6:
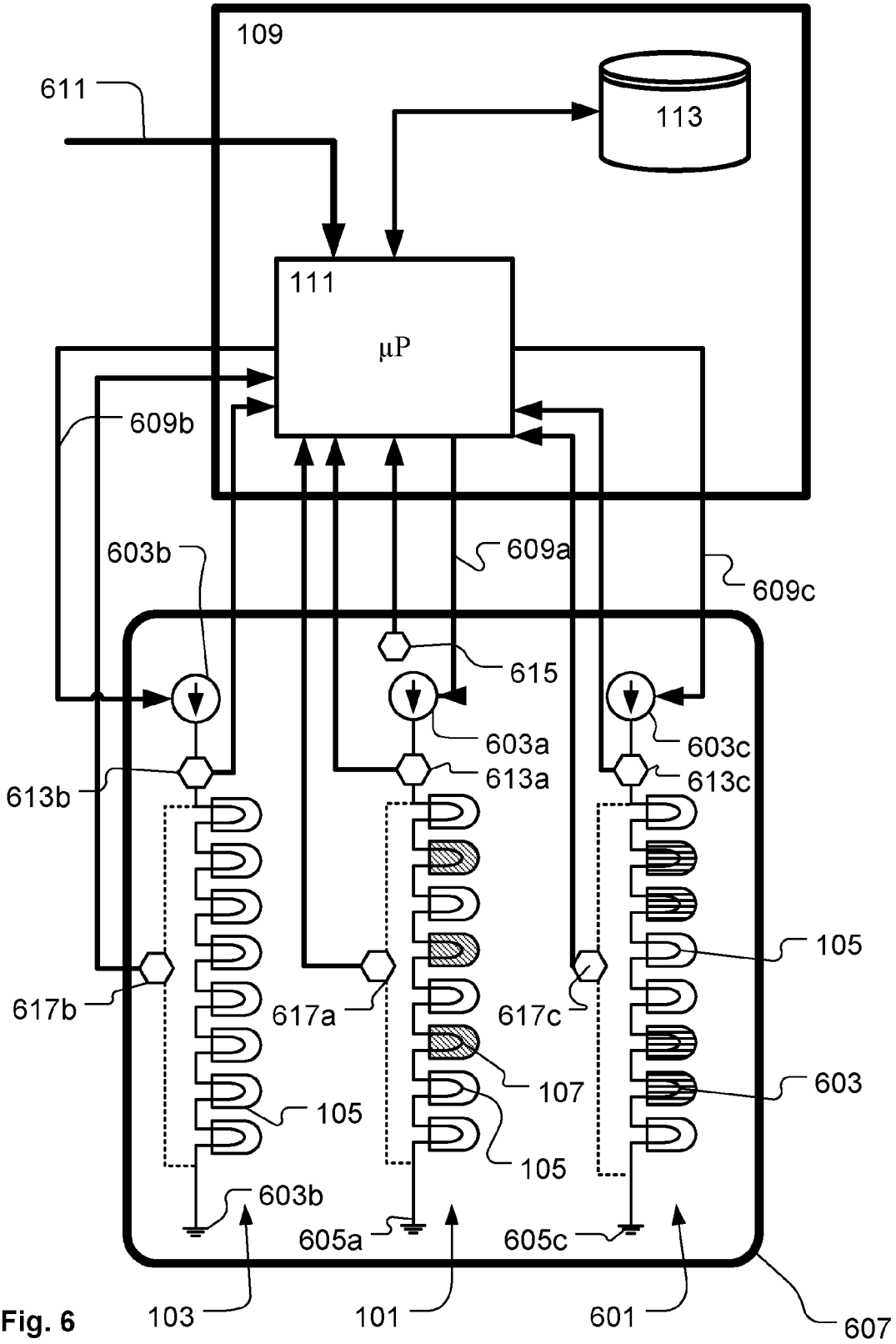
FIG. 6 illustrates another embodiment of an illumination device according to the present invention.

FIG. 6 illustrates a possible embodiment of an illumination device according the present invention. The illumination device comprises like the illumination device of FIG. 1 a first array 101 of light sources and a second 103 array of light sources. The first array 101 comprises a number of a first type light sources 105 and a number of a second type light sources 107 (shaded) whereas the second array 103 only comprises a number the first type light sources 105. The illumination device comprises further a third array 601 of light sources comprising a number of the first type light sources 105 and a number of a third type light sources 603 (shaded different from the second type of light sources).

In this embodiment the light sources of the first 101, second 103 and third 601 arrays are connected in series and between respectively a current source 603*a*, 603*b* and 603*c* and ground 605*a*, 605*b* and 605*c*. The arrays are arranged on a PCB 607 and are for simplicity illustrated as three separate string arrays. However the skilled person realizes that the light sources of the arrays may be uniformly distributed at the PCB in order to create uniform light beam.

The illumination device comprises a control unit 109 comprising a processor 111 and a memory 103. The processing means 111 is adapted to control the first, second and third array of light sources by controlling the intensity of the light sources of each array. Each array of light sources 101, 103 and 601 acts thus as three individual light sources and the illumination device can perform color mixing by controlling the intensity of the three arrays in relation to each other as known in the art of additive color mixing. The processor 111 controls the first 101, second 103 and third array by respectively controlling (indicated by control lines 609*a*, 609*b*, 609*c*) the current sources 603*a*, 603*b*, 603*b* of each array whereby the current flowing through the light sources of each array can be controlled by the processor 111. The intensity of each array can be increased by increasing the current and be decreased by decreasing the current. The current can regulated as a DC, AC, PWM or a combinations as known in the art of intelligent lighting. The processor 111 can also be adapted to control the light source arrays based on an input signal 611 indicative of a target color.

The illustrated illumination device is a very bright single color illumination device where the first type light source acts at the primary color and where second type 105 and third type 603 light sources act as secondary light sources which can be used to compensate/account for the above described problems related to the fact that it, due to the manufacturing, is difficult to provide light sources emitting exact the same color and brightness.

The processing means 111 is further adapted to control the first, second and third array of light sources based on a method as described above, where degrading data of the light source arrays are determined based on driving characteristics of the first array, second array and third array and degrading data of the first, second and third type of light sources. These data are obtained through a calibration process setup similar to the one described in FIG. 2 and the calibration data are store in the in memory 113. The illumination device comprises also current detection means 613*a*, 613*b* and 613*c* cable of detecting the current through respectively the first, second and third array and temperature detecting means 615 detecting the temperature of the PCB 607. The illumination device comprises also voltage detection means 617*a*, 617*b* and 617*c* cable of detecting the voltage across respectively the first, second and third array.

The following is examples of how the method according to the present invention can be implemented and used by the illumination device FIG. 6. It is to be understood that the method can be implemented in many different ways and that the described examples only serve to illustrate possible embodiments and do not limit the scope of the claims.

First Example

The illumination device of FIG. 6 is calibrated prior use for instance in connection with the manufacturing process. However, the skilled person realizes that the illumination device can be calibrated at any time for instance at regular intervals.

Firstly the color characteristics $\overrightarrow{CC_1}$ of the first array 101 are measured using the calibration device 201 of FIG. 2. The color characteristics are measured while driving the first array 101 and keeping the second 103 and third 601 array off. The color characteristics measured by the calibration device can be expressed as a color vector:

$$\overrightarrow{CC_1} = \begin{bmatrix} X_1 \\ Y_1 \\ Z_1 \end{bmatrix} \tag{1}$$

where $X_1$, $Y_1$, $Z_1$ represent the tristimulus vales of the light emitted by the first array.

The current, $CURRENT_{1,calc}$, running through the first array during the measurement of the color characteristics are also measures by current measuring means 613*a*. The voltage $V_{1,calc}$ across the first array are measured by voltage measuring means (617*a*).

Secondly the color characteristics $\overrightarrow{CC_2}$ of the second array 103 are measured using the calibration device 201 of FIG. 2. The color characteristics are measured while driving the second array 103 and keeping the first 101 and third 601 array off. The color characteristics measured by the calibration device can be expressed as a color vector:

$$\overrightarrow{CC_2} = \begin{bmatrix} X_2 \\ Y_2 \\ Z_2 \end{bmatrix} \tag{2}$$

where $X_2$, $Y_2$, $Z_2$ represent the tristimulus values of the light emitted by the second array.

The current, $CURRENT_{2,calc}$, running through the second array during the measurement of the color characteristics are also measures by current measuring means 613*b*. The voltage $V_{2,calc}$ across the second array are measured by voltage measuring means (617*b*)

Thirdly the color characteristics $\overrightarrow{CC_3}$ of the third array 601 are measured using the calibration device 201 of FIG. 2. The color characteristics are measured while driving the third array 601 and keeping the first 101 and second 103 array off. The color characteristics measured by the calibration device can be expressed as a color vector:

$$\overrightarrow{CC_3} = \begin{bmatrix} X_3 \\ Y_3 \\ Z_3 \end{bmatrix} \tag{3}$$

where $X_3$, $Y_3$, $Z_3$ are the tristimulus values of the light emitted by the third array.

The current, $CURRENT_{3,calc}$, running through the third array during the measurement of the color characteristics are also measures by current measuring means 613*c*. The voltage $V_{3,calc}$ across the first array are measured by voltage measuring means (617*c*).

The temperature, $TEMP_{PCB,\ calc}$, of the PCB are also measured during the calibration process. The skilled person realizes that the temperature of the PCB can be measured multiple times for instance in connection with each of the color characteristics. In this example however for the sake of simplicity the PCB temperature are only measured once.

The measured values $\overrightarrow{CC_1}$, $\overrightarrow{CC_2}$, $\overrightarrow{CC_3}$, $CURRENT_{1,calc}$ $CURRENT_{2,calc}$, $CURRENT_{3,calc}$, $V_{1,calc}$, $V_{2,calc}$, $V_{2,calc}$ and $TEMP_{PCB,calc}$ are then stored in memory 113.

Degrading data D1, D2, D3 respectively related to first, 105, second 107 and third type light source are obtained from the light source manufacture and also stored in the memory. The degrading data D1, D2, D3 expresses how much the light sources degrade a function of increased temperature.

The thermal resistance T1, T2, T3 respectively related to first, 105, second 107 and third type light source are obtained from the light source manufacture and also stored in the memory. The thermal resistance T1, T2, T3 expresses how much the temperature of the light sources increases as a function of power consumption.

The processor controls the light source arrays based on determined degrading of the light source arrays and the following describes how this degrading can be determined.

Degrading of Second Array

The degraded color characteristics $\overrightarrow{DCC_2}$ of the second array can be determined by:

$$\overrightarrow{DCC_2}=\overrightarrow{CC_2}\cdot D1\cdot\Delta T \tag{4}$$

where $\overrightarrow{CC_2}$ is the color characteristics of the second array at the time of calibration, D1 is degrading data of the first type light source and ΔT is the temperature difference of the between the present temperature of the light sources and the temperature of the light sources at the time of calibration. This requires that each of the first type light sources of the second array experiences the same degrading which is a reasonable assumption since the same current runs through the light sources and they are arranged on the same PCB.

ΔT is found by using equation (5)

$$\Delta T=T_{2,calc}-T_{2,Present} \tag{5}$$

where $T_{2,calc}$ is the calibration temperature of the light sources of the second array and $T_{2,present}$ is the present temperature of the light sources of the second array. The calibration temperature of the light sources can be found by $$T_{2,calc}=TEMP_{PCB,calc}+T1\cdot CURRENT_{2,calc}\cdot\frac{V_{2,calc}}{n1_2} \tag{6}$$

where $TEMP_{PCB,calc}$ is the temperature of the PCB at the time of calibration, T1 is the thermal resistance of the first type light source. The expression $$CURRENT_{2,calc}\cdot\frac{V_{2,calc}}{n1_2}$$

is the power consumed by each light source, where $CURRENT_{2,calc}$ is the electrical current through light source and $V_{2,calc}$ the voltage across the second array. It is assumed that the voltage, $V_{2,calc}$, is equally distributed between the light sources.

The present temperature $T_{2,present}$ of the light sources can be found by a similar expression except for the difference that present temperature of the PCB board $TEMP_{PCB,\,present}$ and the present current through second array are used $$T_{2,Present}=TEMP_{PCB,Present}+T1\cdot CURRENT_{2,Present}\cdot\frac{V_{2,Present}}{n1_2} \tag{7}$$

Inserting (5), (6), (7) into (4) gives:

$$\overrightarrow{DCC_2}=\overrightarrow{CC_2}\cdot D1\cdot\left(\left(TEMP_{PCB,cal}+T1\cdot CURRENT_{2,calc}\cdot\frac{V_{2,calc}}{n1_2}\right)-\left(TEMP_{PCB,Present}+T1\cdot CURRENT_{2,Present}\cdot\frac{V_{2,Present}}{n1_2}\right)\right) \tag{8}$$

where $\overrightarrow{CC_2}$, $CURRENT_{2,calc}$, $TEMP_{PCB,calc}$ $n1_2$, T1 and $V_{2,calc}$ are stored in the memory 113. $TEMP_{PCT,Present}$, $V_{2,Present}$ and $CURRENT_{2,present}$ are obtained by the temperature measuring means 615, current measuring means 613*b* and a voltage measuring device (not shown).

Degrading of First Array

The degraded color characteristics $\overrightarrow{DCC_1}$ of the first array cannot by determined like the degrading of the second array as the degrading of the first and second type light source are not identical.

Theoretically the degraded color characteristics $\overrightarrow{DCC_1}$ need to be determined as combination of the degrading of the first type light source and the second type light source:

$$\overrightarrow{DCC_1}=\overrightarrow{CC1_1}\cdot D1\cdot\Delta TEMP1\cdot n1_1+\overrightarrow{CC2_1}\cdot D2\cdot\Delta TEMP2\cdot n2_1 \tag{9}$$

where the first part, $\overrightarrow{CC1_1}\cdot D1\cdot\Delta TEMP1\cdot n1_1$, relates to the degrading of the first type light sources and where the second part, $\overrightarrow{CC2_1}\cdot D2\cdot\Delta TEMP2\cdot n2_1$, relates to the degrading of the second type light sources. $\overrightarrow{CC1_1}$ is the color characteristics of a single first type light source and $\overrightarrow{CC1_2}$ is the color characteristics of a single second type light source.

Looking at the first part of equation (9) where $\overrightarrow{CC1_1}$ is the color characteristics of a single first type light sources of the first array at the time of calibration, D1 is degrading data of the first type light source and ΔTEMP1 is the temperature difference between the present temperature of the first type sources and the temperature of the first type light sources at the time of calibration. The first array comprises a number $n1_1$ of the first type light sources and the degrading is thus multiplied by this number as each light source will degrade. D1 and $n1_1$ are known values whereas $\overrightarrow{CC1_1}$ and ΔTEMP1 need to be determined.

$\overrightarrow{CC1_1}$ can be estimated by using the color characteristics $\overrightarrow{CC_2}$ of the second array measured during the calibration process. This is possible if the first type light sources of the first array at the time of calibration are driven similar to the first type light sources of the second array at time of calibration. This is a reasonable assumption if the consumed power of the light sources are substantial the same which for instance is the case if the number of light sources of, the current through the two arrays are the same. $\overrightarrow{CC1_1}$ can thus be estimated as:

$$\overrightarrow{CC1_1}\approx\frac{\overrightarrow{CC_2}}{n1_2} \tag{10}$$

ΔTEMP1 can be determined using $$\Delta TEMP1=TEMP1_{1,cal}-TEMP1_{1,Present} \tag{11}$$

where $TEMP1_{1,cal}$ is the calibration temperature of the first type light sources of the first array and $TEMP1_{1,Present}$ is the present temperature of the light first type sources of the first array. The calibration temperature of the light sources can be found by $$TEMP1_{1,cal} = TEMP_{PCB,calc} + T1 \cdot CURRENT_{1,calc} \cdot \frac{V_{2,calc}}{n1_2} \tag{12}$$

where $TEMP_{PCB,cacl}$ is the temperature of the PCB at the time of calibration, T1 is the thermal resistance of the first type light source. The expression $$CURRENT_{1,calc} \cdot \frac{V_{2,calc}}{n1_2}$$

is the power consumed by each light source of the first array, where $CURRENT_{1,calc}$ is the electrical current through light source and $V_{2,calc}$ the voltage across the second array $n1_2$ is the number of first type light source of the second array. It is assumed that the voltage across each of the first type light sources of the first array and the second array are identical. This is a reasonable assumption as the current flowing though the first and second array are substantial identical and diodes are of the same type.

The present temperature $TEMP1_{1,Present}$ of the light first sources can be found by a similar expression except for the difference that present temperature of the PCB, $TEMP_{PCB,\ present}$, and the present current through first array are used $$TEMP1_{Present} = TEMP_{PCB,Present} + T1 \cdot CURRENT_{1,Present} \cdot \frac{V_{2,present}}{n1_2} \tag{13}$$

Looking at the second part, $\overrightarrow{CC2_1} \cdot D2 \cdot \Delta TEMP2 \cdot n2_1$, of equation (9), where $\overrightarrow{CC2_1}$ is the color characteristics of each of the second type light sources of the first array at the time of calibration, D2 is degrading data of the second type light source and ΔTEMP2 is the temperature difference between the present temperature of the second type sources and the temperature of the second type light sources at the time of calibration. The first array comprises a number $n2_1$ of the second type light sources and the degrading is thus multiplied by this number as each light source will degrade. D2 and $n2_1$ are known values whereas $\overrightarrow{CC2_1}$ and ΔTEMP2 need to be determined.

The measured color characteristics $\overrightarrow{CC_1}$ of the first array is a combination of the color characteristics of the first type light sources and the second type light sources. $\overrightarrow{CC2_1}$ can thus be found by using the color characteristics, $\overrightarrow{CC1_1}$, of the first type light sources of the first array and the color characteristics, $\overrightarrow{CC_1}$, of the first array. The value of $\overrightarrow{CC1_1}$ estimated in equation (10) can be also be inserted into equation (14)

$$\overrightarrow{CC2_1} = \frac{\overrightarrow{CC_1} - \overrightarrow{CC1_1} \cdot n1_1}{n2_1} \approx \frac{\overrightarrow{CC_1} - \frac{n1_1}{n1_2} \cdot \overrightarrow{CC_2}}{n2_1} \tag{14}$$

ΔTEMP2 can be determined using $$\Delta TEMP2 = TEMP2_{1,calc} - TEMP2_{1,Present} \tag{15}$$

where $TEMP2_{1,cal}$ is the calibration temperature of the second type light sources of the first array and $TEMP2_{1,Present}$ is the present temperature of the light second type sources of the first array. The calibration temperature of the light sources can be found by $$TEMP2_{1,calc} = TEMP_{PCB,cal} + T2 \cdot CURRENT_{1,celc} \cdot \frac{V_{1,calc} - \frac{V_{2,calc}}{n1_2} \cdot n1_1}{n2_1} \tag{16}$$

where $TEMP_{PCB,cal}$ is the temperature of the PCB at the time of calibration, T2 is the thermal resistance of the second type light source. The expression $$CURRENT_{1,calc} \cdot \frac{V_{1,calc} - \frac{V_{2,calc}}{n1_2} \cdot n1_1}{n2_1}$$

is the power consumed by each of the second type light sources where $CURRENT_{1,calc}$ is the electrical current through first array, $V_{1,calc}$ is the voltage across the first array, $V2_{,calc}$ is the voltage across the second array, $n1_2$ is the number of first type light sources of the second array, $n1_1$ is the number of the first type light sources of the first array and $n2_1$ is the number of the second type light sources of the first array. The expression $$\frac{V_{1,calc} - \frac{V_{2,calc}}{n1_2} \cdot n1_1}{n2_1}$$

is the voltage across each of the second type light sources of the first array which is derived by subtracting the voltage across all of the first type light source of the first array from the voltage across the first array and dividing this difference by the number of second type light sources of the first array.

The present temperature $TEMP2_{1,Present}$ of the light sources can be found by a similar expression except for the difference that present temperature of the PCB, $TEMP_{PCB,\ present}$, and the present current through and voltage across the first array and the second array are used $$TEMP2_{1,Present} = TEMP_{PCB,Present} + T2 \cdot CURRENT_{1,Present} \cdot \frac{V_{1,Present} - \frac{V_{2,present}}{n1_2} \cdot n1_1}{n2_1} \tag{17}$$

Inserting equation (10), (11), (12), (13), (14), (15), (16) and (17) results into equation (9):

$$\overrightarrow{DCC_1} = \frac{\overrightarrow{CC_2}}{n1_2} \cdot D1 \cdot \left(\left(TEMP_{PCB,calc} + T1 \cdot CURRENT_{1,celc} \cdot \frac{V_{2,calc}}{n1_2}\right) - \left(TEMP_{PCB,Present} + T1 \cdot CURRENT_{1,Present} \cdot \frac{V_{2,present}}{n1_2}\right)\right). \tag{18}$$

-continued $$n1_1 + \frac{\overrightarrow{CC_1} - \frac{n1_1}{n1_2} \cdot \overrightarrow{CC_2}}{n2_1} \cdot$$

$$D2 \cdot \left( \left( TEMP_{PCB,calc} + T2 \cdot CURRENT_{1,calc} \cdot \frac{V_{1,calc} - \frac{V_{2,calc}}{n1_2} \cdot n1_1}{n2_1} \right) - \left( TEMP_{PCB,Present} + T2 \cdot CURRENT_{1,Present} \cdot \frac{V_{1,Present} - \frac{V_{2,present}}{n1_2} \cdot n1_1}{n2_1} \right) \right) \cdot n2_1$$

where $\overrightarrow{CC_1}$ and $\overrightarrow{CC_2}$ are the color characteristics of respectively the first and second array obtained during the calibration process; D1 and D2 are the degrading data of respectively the first and second type light sources; T1 and T2 are the thermal resistance of respectively the first and second type light sources; $n\mathbf{1}_2$ is the number of first type light sources of the second array; $n\mathbf{1}_1$ is the number of first type light sources of the first array; $n\mathbf{2}_1$ are the number of second type light sources of the first array; $TEMP_{PCB,cal}$ is the temperature of the PCB at the time of calibration and $TEMP_{PCB,Present}$ is the present temperature of the PCB; $CURRENT_{1,CAL}$ is the current through the first array during calibration and $CURRENT_{1,Present}$ is the present current through the first array; $V_{1,Present}$ is the present voltage across the first array, $V_{1,calc}$ is the voltage across the first array at calibration; $V_{2,Present}$ is the present voltage across the second array, $V_{1,calc}$ is the voltage across the second array at calibration.

Degrading of Third Array

The degraded color characteristics $\overrightarrow{DCC_3}$ of the second array can be determined in a similar way as the degrading of the first array and can thus to be determined as combination of the degrading of the first type light source and the third type light source:

$$\overrightarrow{DCC_3} = \overrightarrow{CC1_3} \cdot D1 \cdot \Delta TEMP1 \cdot n1_3 + \overrightarrow{CC3_3} \cdot D3 \cdot \Delta TEMP3 \cdot n3_3 \quad (19)$$

where the first part, $\overrightarrow{CC\mathbf{1}_3} \cdot D_1 \cdot \Delta TEMP\mathbf{1} \cdot 3$, relates to the degrading of the first type light sources and where the second part, $\overrightarrow{CC\mathbf{3}_3} \cdot D_2 \cdot \Delta TEMP\mathbf{3} \cdot n\mathbf{3}_3$, relates to the degrading of the third type light sources.

Using similar arguments as those used in connection with the first array equitation (19) can be derived to:

$$\overrightarrow{DCC_3} = \frac{\overrightarrow{CC_2}}{n1_2} \cdot D1 \cdot \left( \left( TEMP_{PCB,calc} + T1 \cdot CURRENT_{3,calc} \cdot \frac{V_{2,calc}}{n1_2} \right) - \left( TEMP_{PCB,Present} + T1 \cdot CURRENT_{3,Present} \cdot \frac{V_{2,present}}{n1_2} \right) \right) \cdot n1_3 + \frac{\overrightarrow{CC_3} - \frac{n1_3}{n1_2} \cdot \overrightarrow{CC_2}}{n3_3} \cdot \quad (20)$$

-continued $$D3 \cdot \left( \left( TEMP_{PCB,cal} + T3 \cdot CURRENT_{3,calc} \cdot \frac{V_{3,calc} - \frac{V_{2,calc}}{n1_2} \cdot n1_3}{n3_3} \right) - \left( TEMP_{PCB,Present} + T3 \cdot CURRENT_{1,Present} \cdot \frac{V_{3,Present} - \frac{V_{2,present}}{n1_2} \cdot n1_3}{n3_3} \right) \right) \cdot n3_3$$

where $\overrightarrow{CC_2}$ and $\overrightarrow{CC_3}$ are the color characteristics of respectively the second and third array obtained during the calibration process; D1 and D3 are the degrading data of respectively the first and third type light sources; T1 and T3 are the thermal resistance of respectively the first and third type light sources; $n\mathbf{1}_2$ is the number of first type light sources of the second array; $n\mathbf{1}_3$ is the number of first type light sources of the third array; $n\mathbf{3}_3$ are the number of third type light sources of the third array; $TEMP_{PCB,cal}$ is the temperature of the PCB at the time of calibration and $TEMP_{PCB,Present}$ is the present temperature of the PCB; $CURRENT_{3,CAL}$ is the current through the third array during calibration and $CURRENT_{3,Present}$ is the present current through the third array; $V_3$ is the voltage across the third array; $V_{1,Present}$ is the present voltage across the first array, $V_{1,calc}$ is the voltage across the first array at calibration; $V_{2,Present}$ is the present voltage across the second array, $V_{1,calc}$ is the voltage across the second array at calibration.

The degrading of the first, second and third array are now determined and the processor can thus regulate the intensity of the first, second and third array in based on the determined degrading data in order to produce a desired color as known in the art.

Second Example

The following is an alternative example of how the method according to the present invention can be implemented and used by the illumination device of FIG. 6.

In this example the illumination device of FIG. 6 is like in the first example calibrated prior use, where the following values like in the first example are measured: $\overrightarrow{CC_1}$, $\overrightarrow{CC_2}$, $\overrightarrow{CC_3}$, $CURRENT_{1,calsl}$ $CURRENT_{2,calc}$, $CURRENT_{3,calc}$, $V_{1,calc}$, $V_{2,calc}$, $V_{3,calc}$ and $TEMP_{PCB,calc}$.

Further a first additional color characteristics $\overrightarrow{CC'_1}$ of the first array 101 are measured using the calibration device 201 of FIG. 2. The first additional color characteristics $\overrightarrow{CC'_1}$ are measured while driving the first array 101 and keeping the second 103 and third 601 array off. Further the first type light sources of the first array are blinded such that the light from these light sources are not measured by the calibration device. In other words the first additional color characteristics $\overrightarrow{CC'_1}$ corresponds to the color characteristics of the second light sources of the second array. Alternatively the first type light sources can also be turned off by short circuiting them e.g. by sing a number of jumpers.

The skilled person realizes the first additional color characteristics also can be measured with the second type light sources blinded and will be able to adjust the equations below in relation to this.

The first additional color characteristics measured by the calibration device can be expressed as a color vector:

$$\overrightarrow{CC'_1} = \begin{bmatrix} X'_1 \\ Y'_1 \\ Z'_1 \end{bmatrix} \tag{21}$$

where $X'_1$, $Y'_1$, $Z'_1$ represent the tristimulus vales of the light emitted by the second light sources of the first array.

Third additional color characteristics $\overrightarrow{CC'_3}$ of the third array 101 are also measured using the calibration device 201 of FIG. 2. The third additional color characteristics $\overrightarrow{CC'_3}$ are measured while driving the third array 601 and keeping the first 101 and second array 103 off. Further the first type light sources of the third array are blinded such that the light from these light sources are not measured by the calibration device. In other words the first additional color characteristics $\overrightarrow{CC'_3}$ corresponds to the color characteristics of the third light sources of the third array. Alternatively the third type light sources can also be turned off by short circuiting them e.g. by sing a number of jumpers.

The third additional color characteristics measured by the calibration device can be expressed as a color vector:

$$\overrightarrow{CC'_3} = \begin{bmatrix} X'_3 \\ Y'_3 \\ Z'_3 \end{bmatrix} \tag{22}$$

where $X'_3$, $Y'_3$, $Z'_3$ represent the tristimulus vales of the light emitted by the third light sources of the third array.

Degrading of Second Array

The degraded color characteristics $\overrightarrow{DCC_2}$ of the second array can be determined by like in the first example and as defined by equation (8):

$$\overrightarrow{DCC_2} = \overrightarrow{CC_2} \cdot D1 \cdot \left(\left(TEMP_{PCB,cal} + T1 \cdot CURRENT_{2,calc} \cdot \frac{V_{2,calc}}{n1_2}\right) - \left(TEMP_{PCB,Present} + T1 \cdot CURRENT_{2,Present} \cdot \frac{V_{2,present}}{n1_2}\right)\right) \tag{23}$$

where $\overrightarrow{CC_2}$, $CURRENT_{2,calc}$, $TEMP_{PCB,calc}$ $n1_2$, T1 and $V_{2,calc}$ are stored in the memory 113. $TEMP_{PCT,Present}$, $V_{2,Present}$ and $CURRENT_{2,Present}$ are obtained by the temperature measuring means 615, current measuring means 613*b* and a voltage measuring device (not shown).

Degrading of First Array

As in the first example the degraded color characteristics $\overrightarrow{DCC_1}$ of the first array cannot by determined like the degrading of the second array as the degrading of the first and second type light source are not identical.

Theoretically the degraded color characteristics $\overrightarrow{DCC_1}$ need like in the first example to be determined as combination of the degrading of the first type light source and the second type light source:

$$\overrightarrow{DCC_1} = \overrightarrow{CC1_1} \cdot D1 \cdot \Delta TEMP1 \cdot n1_1 + \overrightarrow{CC2_1} \cdot D2 \cdot \Delta TEMP2 \cdot n2_1 \tag{24}$$

where the first part, $\overrightarrow{CC1_1} \cdot D1 \cdot \Delta TEMP1 \cdot n1_1$, relates to the degrading of the first type light sources and where the second part, $\overrightarrow{CC2_1} \cdot D2 \cdot \Delta TEMP2 \cdot n2_1$, relates to the degrading of the second type light sources. $\overrightarrow{CC1_1}$ is the color characteristics of a single first type light source and $\overrightarrow{CC1_2}$ is the color characteristics of a single second type light source.

In this example the color characteristics of each of second type light sources, $\overrightarrow{CC2_1}$, of the first array at the time of calibration can be derived from the first additional color characteristics, $\overrightarrow{CC'_1}$, as this color vector corresponds to the color characteristics of all of the second light sources of the second array whereby:

$$\overrightarrow{CC2_1} = \frac{\overrightarrow{CC'_1}}{n2_1} \tag{25}$$

The color characteristics of each of the first type light sources, $\overrightarrow{CC1_1}$, of the first array at the time of calibration can be determined from the color characteristics of the first array, $\overrightarrow{CC_1}$, and the first additional color characteristics $\overrightarrow{CC'_1}$:

$$\overrightarrow{CC1_1} = \frac{\overrightarrow{CC_1} - \overrightarrow{CC'_1}}{n1_1} \tag{26}$$

ΔTEMP1 can be determined using equations (11), (12) and (13) and ΔTEMP2 can be determined using equation (15), (16) and (17) as described in the first example above. The skilled person will be able to determine the degrading of the first array by inserting equations (11), (12), (13), (15), (16), (17), (25) and (26) into equation (24):

$$\begin{aligned}\overrightarrow{DCC_1} = {} & \frac{\overrightarrow{CC_1} - \overrightarrow{CC'_1}}{n1_1} \cdot D1 \cdot \left(\left(TEMP_{PCB,calc} + T1 \cdot CURRENT_{1,celc} \cdot \frac{V_{2,calc}}{n1_2}\right) - \left(TEMP_{PCB,Present} + T1 \cdot CURRENT_{1,Present} \cdot \frac{V_{2,present}}{n1_2}\right)\right) \cdot \\ & n1_1 + \frac{\overrightarrow{CC'_1}}{n2_1} \cdot D2 \cdot \left(\left(TEMP_{PCB,calc} + T2 \cdot CURRENT_{1,calc} \cdot \frac{V_{1,calc} - \frac{V_{2,calc}}{n1_2} \cdot n1_1}{n2_1}\right) - \left(TEMP_{PCB,Present} + T2 \cdot CURRENT_{1,Present} \cdot \frac{V_{1,Present} - \frac{V_{2,present}}{n1_2} \cdot n1_1}{n2_1}\right)\right) \cdot n2_1\end{aligned} \tag{27}$$

Degrading of Third Array

The degrading of the third array can be determined by using similar arguments:

$$\overrightarrow{DCC_3} = \frac{\overrightarrow{CC_3} - \overrightarrow{CC_3'}}{n1_3} \cdot D1 \cdot \left(\left(TEMP_{PCB,calc} + T1 \cdot CURRENT_{3,calc} \cdot \frac{V_{2,calc}}{n1_2}\right) - \left(TEMP_{PCB,Present} + T1 \cdot CURRENT_{3,Present} \cdot \frac{V_{2,present}}{n1_2}\right)\right) \cdot n1_3 + \frac{\overrightarrow{CC_3'}}{n3_3} \cdot D3 \cdot \left(\left(TEMP_{PCB,cal} + T3 \cdot CURRENT_{3,calc} \cdot \frac{V_{3,calc} - \frac{V_{2,calc}}{n1_2} \cdot n1_3}{n3_3}\right) - \left(TEMP_{PCB,Present} + T3 \cdot CURRENT_{1,Present} \cdot \frac{V_{3,Present} - \frac{V_{2,present}}{n1_2} \cdot n1_3}{n3_3}\right)\right) \cdot n3_3 \quad (28)$$

The degrading of the first, second and third array are now determined and the processor can thus regulate the intensity of the first, second and third array in based on the determined degrading data in order to produce a desired color as known in the art.

What is claimed is:

1. A method of controlling an illumination device, where said illumination device comprises:

a first array of light sources comprising a number of a first type light sources and a number of a second type light sources;

a second array of light sources comprising a number of only said first type light sources;

said method comprises the steps of:

controlling said first array by simultaneously controlling the intensity of all of said light sources of said first array by driving all of said light sources of said first array at a same, first intensity level by a same first control signal or first identical control signals;

controlling said second array by simultaneously controlling the intensity of all of said light sources of said second array by driving all of said light sources of said second array at a same, second intensity level by a same second control signal or second identical control signals, where said same first control signal or said first identical control signals is different from said same second control signal or said second identical control signals; and individually performing said controlling of said first array and said second array;

wherein said method further comprises the steps of:

obtaining first driving characteristics related to said first array;

obtaining second driving characteristics related to said second array;

obtaining first degrading data related to said first type light sources;

obtaining second degrading data related to said second type light sources;

determining degrading of said first array based on said first driving characteristics, said second driving characteristics, said first degrading data and said second degrading data;

wherein said step of controlling said first array is based on said determined degrading of said first array; and wherein said step of determining degrading of said first array comprises the steps of:

dividing said first array into a first virtual array and a second virtual array, where said first virtual array represents said first type light sources of said first array and said second virtual array represents said second type light sources of said first array;

determining first virtual driving characteristics of said first virtual array based on said second driving characteristics;

determining second virtual driving characteristics of said second virtual array based on said first driving characteristics and said second driving characteristics of said second array;

determining degrading of said first virtual array based on said first virtual driving characteristics and said first degrading data;

determining degrading of said second virtual array based on said second virtual driving characteristics of and said second degrading data; and combining said degrading of said first virtual array and said degrading of said second virtual array into said degrading of said first array.

2. The method according to claim 1, wherein said step of obtaining said first driving characteristics comprises the step of obtaining first color characteristics related to said first array and wherein said step of determining degrading of said first array is based on said first color characteristics.

3. The method according to claim 1, wherein said step of obtaining said second driving characteristics comprises the step of obtaining second color characteristics related to said second array and wherein said step of determining degrading of said first array is based on said second color characteristics.

4. The method according to claim 1, wherein said step of obtaining said first driving characteristics comprises the steps of:

obtaining a first calibration temperature parameter related to at least one of said light sources of said first array; and obtaining a first present temperature parameter related to the present temperature of at least one of said light sources of said first array;

wherein said step of determining degrading of said first array is based on said first calibration temperature parameter and said first present temperature parameter.

5. The method according to claim 1, wherein said step of obtaining said second driving characteristics comprises the steps of:

obtaining a second calibration temperature parameter related to at least one of said light sources of said second array; and obtaining a second present temperature parameter related to the present temperature of at least one of said light sources of said second array;

wherein said step of determining degrading of said first array is based on said second calibration temperature and said second present temperature parameter.

6. The method according to claim 1, wherein said same, first intensity level is different from said same, second intensity level.

7. A method of controlling an illumination device, where said illumination device comprises:

a first array of light sources comprising a number of a first type light sources and a number of a second type light sources;

a second array of light sources comprising a number of said first type light sources;

said method comprises the steps of:

controlling said first array by simultaneously controlling the intensity of all of said light sources light sources of said first array;

controlling said second array by simultaneously controlling the intensity of all of said light sources of said second array;

individually performing said controlling of said first array and said second array; and wherein said method further comprises the steps of:

obtaining first driving characteristics related to said first array;

obtaining second driving characteristics related to said second array;

obtaining first degrading data related to said first type light sources;

obtaining second degrading data related to said second type light sources;

determining degrading of said first array based on said first driving characteristics, said second driving characteristics, said first degrading data and said second degrading data; and wherein said step of controlling said first array is based on said determined degrading of said first array; and wherein said step of determining degrading of said first array comprises the steps of:

dividing said first array into a first virtual array and a second virtual array, where said first virtual array represents said first type light sources of said first array and said second virtual array represents said second type light sources of said first array;

determining first virtual driving characteristics of said first virtual array based on said second driving characteristics;

determining second virtual driving characteristics of said second virtual array based on said first driving characteristics and said second driving characteristics of said second array;

determining degrading of said first virtual array based on said first virtual driving characteristics and said first degrading data;

determining degrading of said second virtual array based on said second virtual driving characteristics of and said second degrading data; and combining said degrading of said first virtual array and said degrading of said second virtual array into said degrading of said first array.

8. The method according to claim 7, wherein controlling said first array by simultaneously controlling the intensity of all of said light sources of said first array is by driving all of said light sources of said first array by a same control signal or by identical control signals; and controlling said second array by simultaneously controlling the intensity of all of said light sources of said second array is by driving all of said light sources of said second array by another control signal or by another set of identical control signals.

9. An illumination device comprising:

a first array of light sources comprising a number of a first type light sources and a number of a second type light sources;

a second array of light sources comprising a number of only said first type light sources; and a processor adapted to:

control said first array by simultaneously controlling the intensity of all of said light sources of said first array by driving all of said light sources of said first array at a same, first intensity level by a same first control signal or first identical control signals; and control said second array by simultaneously controlling the intensity of all of said light sources of said second array by driving all of said light sources of said second array at a same, second intensity level by a same second control signal or second identical control signals, where said same first control signal or said first identical control signals is different from said same second control signal or said second identical control signals;

wherein said processor is configured to obtain:

first driving characteristics related to said first array;

second driving characteristics related to said second array;

first degrading data related to said first type light sources; and second degrading data related to said second type light sources;

wherein said processor is adapted to determine degrading of said first array based on said first driving characteristics, said second driving characteristics, said first degrading data and said second degrading data and is adapted to control said first array based on said determined degrading of said first array; and wherein said processor is adapted to determining degrading of said first array by:

dividing said first array into a first virtual array and a second virtual array, where said first virtual array represents said first type light sources of said first array and said second virtual array represents said second type light sources of said first array;

determining first virtual driving characteristics of said first virtual array based on said second driving characteristics;

determining second virtual driving characteristics of said second virtual array based on said first driving characteristics and said second driving characteristics of said second array;

determining degrading of said first virtual array based on said first virtual driving characteristics and said first degrading data;

determining degrading of said second virtual array based on said second virtual driving characteristics of and said second degrading data; and combining said degrading of said first virtual array and said degrading of said second virtual array into said degrading of said first array.

10. The illumination device according to claim 9, wherein said first driving characteristics obtained by said processor comprises first color characteristics related to said first array, wherein said processor is adapted to determine said degrading of said first array based on said first color characteristics.

11. The illumination device to claim 9, wherein said second driving characteristics obtained by said processor comprises second color characteristics related to said second array, wherein said processor is adapted to determine said degrading of said first array is based on said second color characteristics.

12. The illumination device according to claim 9, wherein said first driving characteristics obtained by said processor comprises:

a first calibration temperature parameter related to at least one of said light sources of said first array; and a first present temperature parameter related to the present temperature of at least one of said light sources of said second array;

wherein said processor is adapted to determine said degrading of said first array based on said first calibration temperature parameter and said second present temperature parameter.

13. The illumination device according to claim 9, wherein said second driving characteristics obtained by said processor comprises:

a second calibration temperature parameter related to at least one of said light sources of said second array; and a second present temperature parameter related to the present temperature of at least one of said light sources of said second array;

wherein said processor is adapted to determine said degrading of said first array based on said second calibration temperature and said second present temperature parameter.

14. The illumination device according to claim 9, wherein the overall intensity provided by said first type light sources of said first and said second array are larger than the overall intensity provided by said second type light sources.

15. The illumination device according to claim 9, wherein said same, first intensity level is different from said same, second intensity level.

16. An illumination device comprising:

a first array of light sources comprising a number of a first type light sources and a number of a second type light sources;

a second array of light sources comprising a number of said first type light sources; and a processor adapted to:

control said first array by simultaneously controlling the intensity of all of said light sources of said first array; and control said second array by simultaneously controlling the intensity of all of said light sources of said second array; and wherein said processor is configured to obtain:

first driving characteristics related to said first array;

second driving characteristics related to said second array;

first degrading data related to said first type light sources;

second degrading data related to said second type light sources; and wherein said processor is adapted to determine degrading of said first array based on said first driving characteristics, said second driving characteristics, said first degrading data and said second degrading data and is adapted to control said first array based on said determined degrading of said first array; and wherein said processor is adapted to determining degrading of said first array by:

dividing said first array into a first virtual array and a second virtual array, where said first virtual array represents said first type light sources of said first array and said second virtual array represents said second type light sources of said first array;

determining first virtual driving characteristics of said first virtual array based on said second driving characteristics;

determining second virtual driving characteristics of said second virtual array based on said first driving characteristics and said second driving characteristics of said second array;

determining degrading of said first virtual array based on said first virtual driving characteristics and said first degrading data;

determining degrading of said second virtual array based on said second virtual driving characteristics of and said second degrading data;

combining said degrading of said first virtual array and said degrading of said second virtual array into said degrading of said first array.

17. The illumination device according to claim 16, wherein the processor adapted to control said first array by simultaneously controlling the intensity of all of said light sources of said first array is by driving all of said light sources of said first array by a same control signal or by identical control signals; and to control said second array by simultaneously controlling the intensity of all of said light sources of said second array is by driving all of said light sources of said second array by another control signal or by another set of identical control signals.

* * * * *